United States Patent [19]

Schuller

[11] 4,222,333

[45] Sep. 16, 1980

[54] RAILWAY HOPPER CAR CLOSURE ACTUATING MECHANISM

[75] Inventor: James J. Schuller, Crete, Ill.

[73] Assignee: Pullman Incorporated, Chicago, Ill.

[21] Appl. No.: 846,295

[22] Filed: Oct. 28, 1977

[51] Int. Cl.[2] ..... B61D 7/02; B61D 7/18; B61D 7/26

[52] U.S. Cl. ..... 105/250; 105/251; 105/307

[58] Field of Search ..... 105/240, 241 C, 248, 105/250, 251, 307, 283

[56] References Cited

U.S. PATENT DOCUMENTS

| | | | |
|---|---|---|---|
| 483,200 | 9/1892 | Anderson | 105/307 X |
| 1,908,096 | 5/1933 | Yost | 105/250 |
| 2,927,541 | 3/1960 | Lunde | 105/283 X |
| 3,145,057 | 8/1964 | Taggart | 105/283 X |
| 3,173,381 | 3/1965 | Charles et al. | 105/240 |
| 3,227,100 | 1/1966 | Smith et al. | 105/241 C |
| 3,316,858 | 5/1967 | Fritz | 105/241 C |
| 3,385,231 | 5/1968 | Dorey | 105/250 |
| 3,447,485 | 6/1969 | Dorey | 103/307 |

*Primary Examiner*—John J. Love
*Assistant Examiner*—Howard Beltran
*Attorney, Agent, or Firm*—Richard J. Myers

[57] ABSTRACT

A discharge gate arrangement for railroad hopper cars having longitudinally extending discharge openings arranged in a horizontal plane beneath the hopper. Gate members arranged in pairs swing in opposite directions transversely of the car. Each gate member is pivotally hung and attached to an operating mechanism that includes a transversely extending shaft having two oppositely threaded portions. The operating mechanism includes split nuts located on the threaded shaft portions with attached links connected to the gate members in order that rotation of the shaft in one direction moves the split nuts in opposite directions and causes the cooperating gates to open and close simultaneously.

7 Claims, 7 Drawing Figures

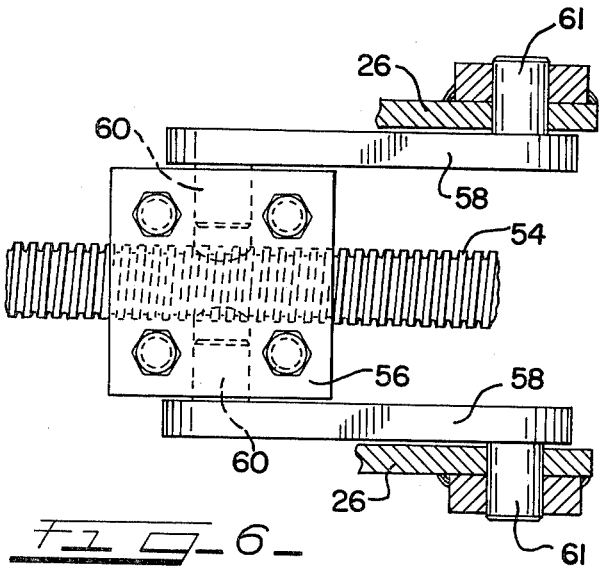
FIG. 6
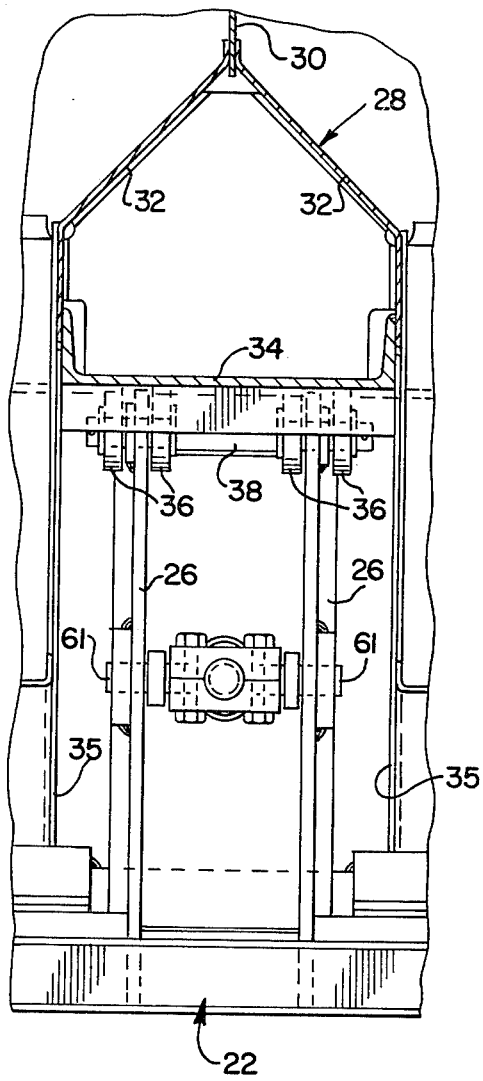
FIG. 5
FIG. 7
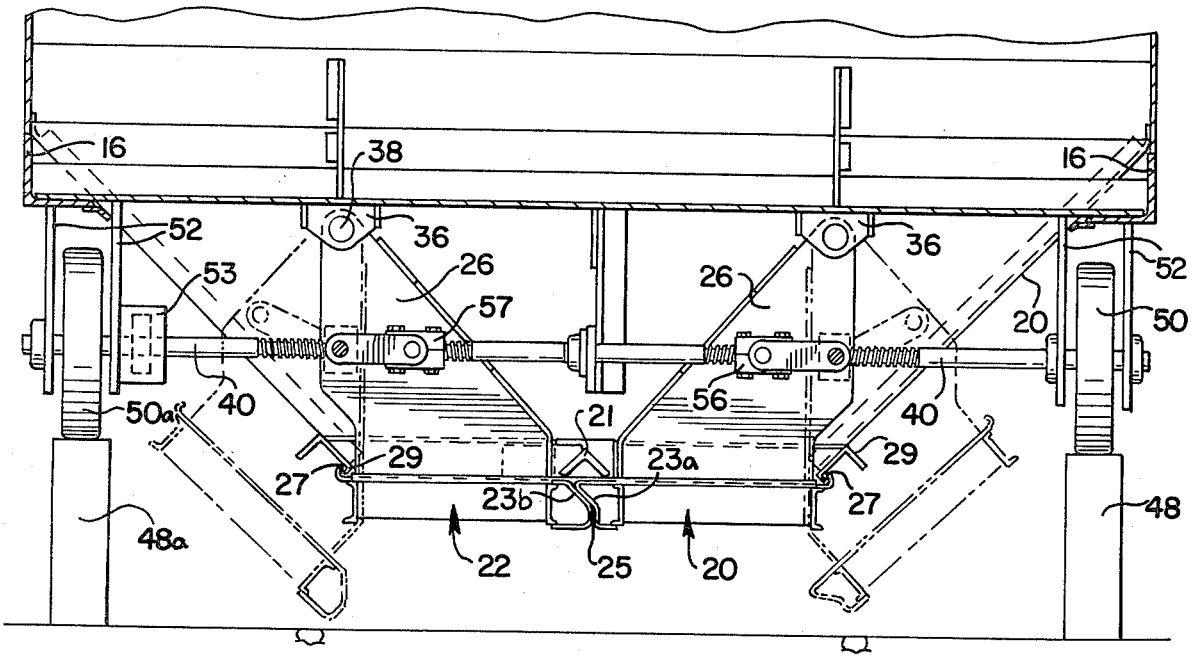

RAILWAY HOPPER CAR CLOSURE ACTUATING MECHANISM

BACKGROUND OF THE INVENTION (1) Nature of the Invention

This invention pertains to railway hopper cars and in particular to hopper cars having longitudinally extending discharge openings with elongated gates for opening and closing the hopper. More particularly, this invention pertains to an operating mechanism used to open and close longitudinally extending hopper discharge gates through rotation of a shaft having oppositely threaded sections connected through a linkage with door supporting hangers.

(2) Description of the Prior Art

While the prior art has disclosed some gates that extend longitudinally of the hopper car and provide a floor or bottom to horizontally dispose a discharge opening, the actuating mechanisms used to operate theses doors has not met with widespread acceptance because oftentimes the mechanism includes a complicated mechanical linkage. For example, U.S. Pat. No. 3,173,381 (1965) to Charles et al. discloses a longitudinally extending discharge gate and an associated operating mechanism. This complex structure has not met with widespread acceptance because of the cost involved with the materials and the time necessary to install and adjust the mechanism. Further, the Charles et al. mechanism requires the use of costly pneumatic cylinders and associated controls for proper functioning which require periodic maintenance.

SUMMARY OF THE INVENTION

This disclosure pertains to a railway hopper car having horizontally extending pairs of discharge gates and an associated operating mechanism which provides a rotating actuating shaft that can be operated from either side of the car to open and close the discharge gates.

In operation, the actuating shaft has a pair of spaced, oppositely threaded portions with threaded nut members positioned thereon and connected with the associated discharge gates through a suitable pivoting linkage. Upon rotation of the actuating shaft the attached nuts move horizontally in opposite directions to open and close the respective attached gate member.

The operating shaft may be rotated manually or may be used in conjunction with a cam arrangement for automatically opening and closing the discharge gates through the use of a trackside cam track that engages a wheel or other suitable member for rotating the actuating shaft as the car moves along the track.

It is an object of this invention to provide a discharge gate and its associated operating mechanism that may be easily operated from trackside either manually or through an automatic cam track mechanism.

It is another object of this invention to provide horizontally extending discharge gates that form the bottom of a hopper structure and may be conveniently moved away from the associated discharge openings to permit rapid and complete discharge of the associated hoppers.

It is yet another object of this invention to provide discharge gates that open and close simultaneously in order to allow one gate to overlap and support the second gate in a sealed fashion with the use of a compressive gasket member.

It is yet another object of this invention to provide a discharge gate operating mechanism for opening and closing longitudinally extending discharge gates by providing a mechanism located at the center of the gate which will operate to easily open and close the gate which is hinged at both ends and in the middle without the necessity for using additional operating mechanisms at the ends of the gate.

These and other objects of the invention will become apparent to those having ordinary skill in the art with reference to the following description, drawings and claims.

BRIEF DESCRIPTION OF THE DRAWINGS

FIG. 5 is an enlarged sectional view taken generally along lines 5—5 of FIG. 2;

FIG. 6 is an enlarged section view taken generally along lines 6—6 of FIG. 2; and FIG. 7 shows a modification of the invention as would be used with a cam track arrangement located at trackside.

DETAILED DESCRIPTION

Figure 1:
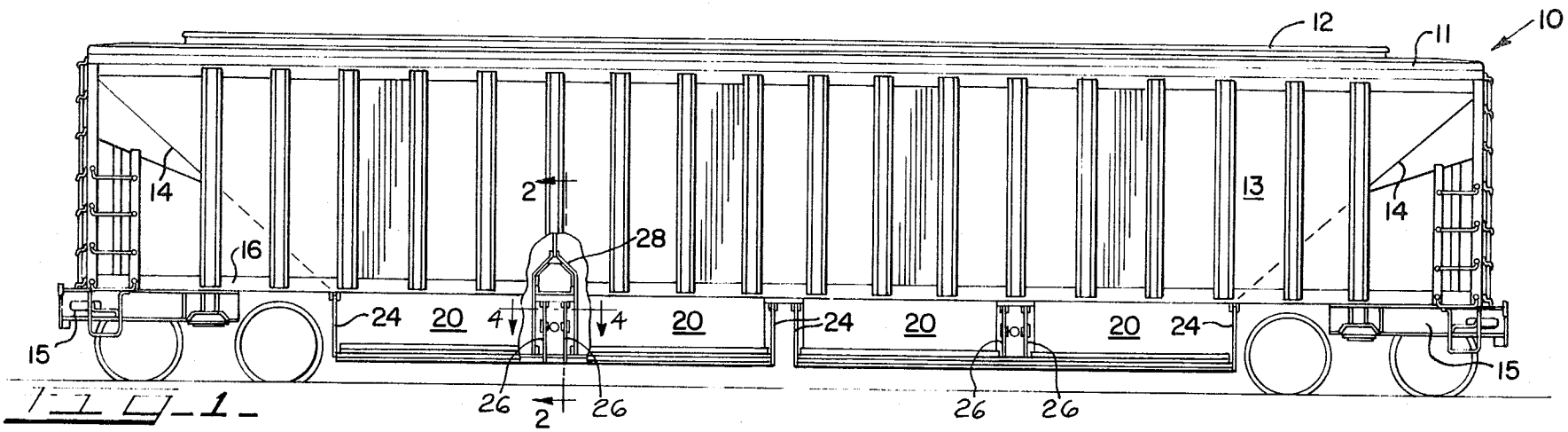
FIG. 1 is a side elevational view of a railway hopper car having a discharge gate arrangement of this disclosure.

Referring now to the drawings and in particular to FIG. 1, there is shown generally a railway hopper car 10 having a roof 11. The roof includes an opening in the form of a trough hatch opening and associated cover 12. It is also contemplated that individual hatch openings may be used with this invention, the trough hatch opening is not a necessity. Hopper car 10 includes the usual end slope sheets 14 and a framing provided by a draft sill 15 at each end and a longitudinally extending side sill structure 16 that extends the length of the car.

Figure 3:
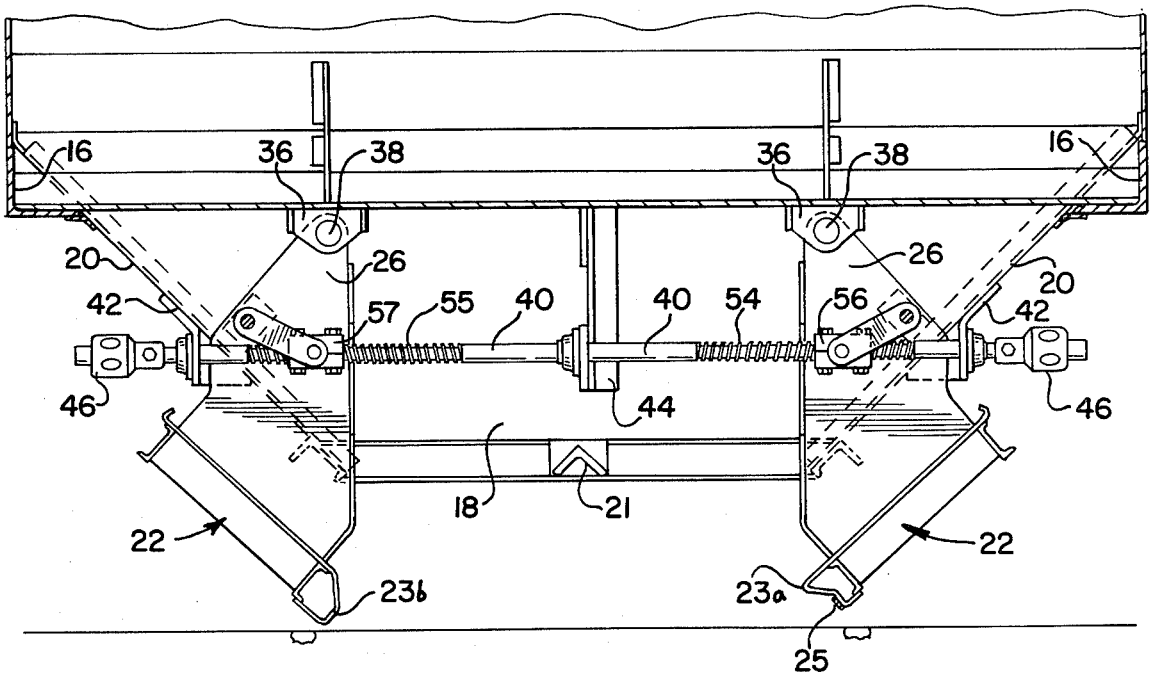
FIG. 3 is a view similar to FIG. 2, showing the discharge gates in the open position.
Figure 4:
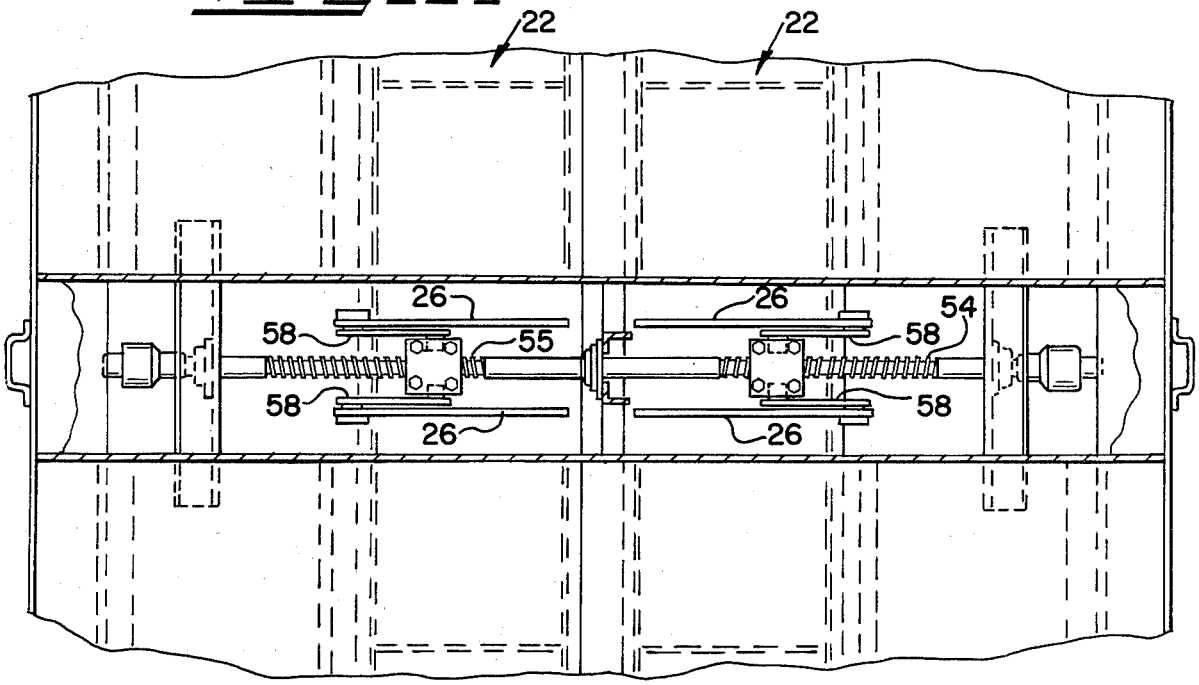
FIG. 4 is a sectional view taken generally along lines 4—4 of FIG. 1.

As shown in FIG. 3, the hopper car 10 includes hopper discharge openings 18 that permit lading contained within the hopper car to be discharged in a rapid fashion between the rails. The hopper discharge opening 18 is a framed rectangular opening. The discharge opening 18 extends generally in horizontal direction parallel with the ground. To provide for rapid discharge of the hoppers, side slope sheets 20 function to direct lading into the discharge opening 18.

Discharge gates 22 are rigid, elongated members that are pivotally mounted to open and close discharge openings 18 and control the flow of lading therethrough. Discharge gates 22 include overlapping lip portions 23*a*, 23*b*, that fit together underneath the support bar 21 (see FIG. 2). When the gates 22 are completely closed, the overlapping lips are joined by a resilient member 25 that acts as a seal to prevent undesirable discharge from the hopper. The gates are also sealed at their outer edges by gasket 27 that is placed between the girder 29 and an upturned edge of gate 22.

As shown in FIG. 1, the gates are supported at each end by end hangers 24. A central portion of the discharge gates 22 is supported by intermediate hangars 26 that are located within a crossridge 28 that extends transversely of the hopper car 10. Crossridge 28 is located in line with an associated intermediate hopper bulkhead 30 (FIG. 5) and includes a pair of downwardly diverging slope plates 32 that extend to a channel shaped cross member 34 to provide a rigid tube extending transversely of the hopper car. Extending downwardly from the crossridge 28 are end sheets 35 that form sides of a housing for the door operating mechanism.

Intermediate hangars 26 are pivotally mounted to the underside of the crossridge 28 with pairs of hinge lugs 36 and hinge pins 38 that provide for pivotal movement of the discharge gates.

Figure 2:
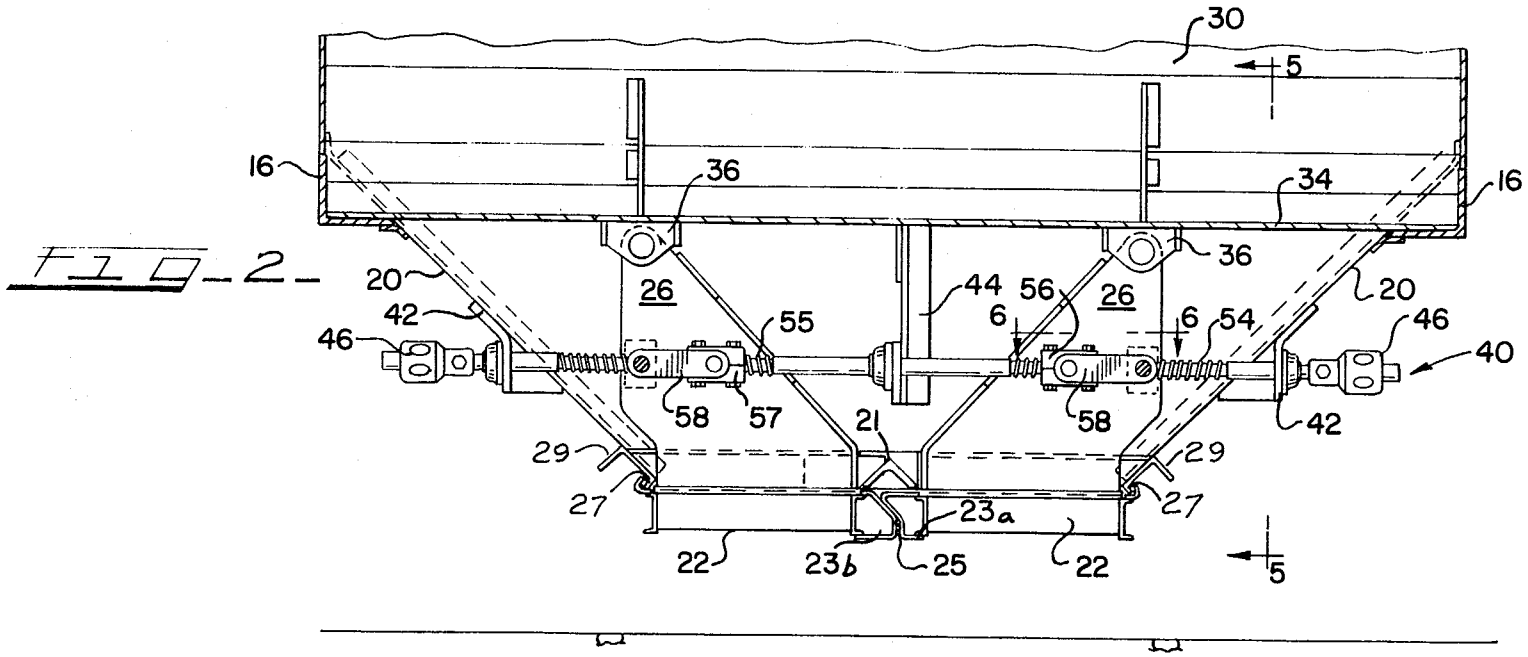
FIG. 2 is an enlarged sectional view taken along lines 2—2 of FIG. 1.

Referring now to FIG. 2 for an explanation of the gate operating mechanism, there is shown an actuating shaft 40 that extends horizontally and transversely of the vehicle within the housing provided by the crossridge 28 and associated end sheets 35. Actuating shaft 40 is attached to the car by end mounting brackets and bearings 42 which are attached to the underside of the side slope sheets 20 and also by use of intermediate mounting brackets and bearings 44 which are attached to the underside of crossridge 28. As shown, the mounting brackets 42, 44 also include suitable bearings to absorb radial and thrust loads that are incurred during operating of the gate operating mechanism. Each actuating shaft 40 may include an actuating crank 46 to allow for manual rotation from trackside.

Each shaft 40 of gate operating mechanism can also be rotated automatically as the hopper car 10 moves over a collection area by use of cam wheels **50, 50*a* attached at each end of the shaft 40. As shown in FIG. 7, when cam wheels 50, 50*a* are utilized, shaft 40 is extended to a point below side sills 16 and is attached to the car in a rigid manner by use of the hangar brackets 52. Cam wheels 50, 50*a* are of such a size and material as to cooperate with cam track 48 for opening and cam track 48*a*** for closing of the discharge gates as the hopper car moves along the track.

Cam track 48 would be used when the car is traveling in a direction coming out of the paper to open the discharge gates. Cam track **48*a*, positioned downtrack from track 48, would be used to close the discharge gates. To permit the gates to open and close without reversing the direction of travel of the car 10, a gear box 53 associated with cam wheel 50*a* reverses rotation of the actuating shaft 40 for rotation in an opposite direction from the rotation produced by cam wheel 50 to thereby close discharge gates 22**.

Referring to FIG. 3, the operating mechanism and associated structure will be described. It is noticed that the actuating shaft 40 includes two threaded portions that have threads cut in opposite directions. For example, the thread portion indicated at 54 is a left hand thread and the associated thread portion designated 55 is a right hand thread for purposes of this example. Placed about these threaded portions are suitably internally threaded split nuts 56, 57 having portions that are held together by mechanical fasteners.

As shown in FIG. 6, split nut 56 is positioned about its associated threaded shaft portion 54 and is attached to connector links 58 located each side. The connector links 58 are pivotally attached at 60 to split nut 56. Connector pins 61 connect the other end of links 58 to the intermediate discharge gate hangars 26. Thus, it is shown that upon rotation of the actuating shaft 40 the split nuts 56 and 57 will move horizontally along the shaft 40 in opposite directions. Because the split nuts 56, 57 are connected by links 58 to the respective gate hangars the gates 22 will move pivotally upon actuation of the rotating shaft.

Operation

The operation of the discharge gate operating mechanism will first be given with reference to the manual operation. When it is desirable to open a discharge gate from the closed position illustrated in FIG. 2 to the open position as illustrated in FIG. 3, the operator engages actuating crank 46 at trackside and rotates it in a counter-clockwise (right) direction as viewed from the right in FIG. 2. Rotation of crank 46 rotates the attached actuating shaft 40 which produces a horizontal movement of the split nuts 56, 57. The counter-clockwise rotation of shaft 40 causes the split nuts 56, 57 to move horizontally away from each other, and the attached connector links 58 cause the door hangers to rotate about their respective pivot pins 38 and in so doing to move away from the hopper discharge opening 18 to permit lading to flow freely from the hoppers. The shaft is rotated until the discharge gates 22 are in the position shown in FIG. 3.

To close the gate the shaft is rotated in the opposite direction until the gate returns to the position shown in FIG. 2. It is noted that the position shown in FIG. 2 shows the lip members **23*a*, 23*b* in an overlapping position with seal 25** compressed to provide a seal to keep out moisture and contaminants and to prevent lading from leaking from within the hoppers.

Referring now to FIG. 7, operation of the trackside cam track and its associated rotating wheels is described. As has been mentioned briefly earlier in the description, when the railway hopper car 10 moves along trackside in a direction coming out of the paper as shown in FIG. 7 and the wheel 50 engages its associated cam track 48 resulting in counter-clockwise rotation of shaft 40 as viewed from the right side in FIG. 7, the split nuts 56, 57 will move horizontally away from each other and open up the hopper discharge gates 22. To close the discharge gates a second cam track **48*a* engages its associated wheel 50*a* to rotate the actuating shaft 40. It is necessary to use a gear box 53 to reverse rotation of the shaft 40 without reversing direction of travel of the hopper car 10 to permit the split nuts 57 to move together to close the associated discharge gates 22**.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. In a railway car having a hopper with an opening for discharge of lading and oppositely swinging doors forming a generally horizontal floor of said hopper in the closed position supported by hanger means mounted on generally parallel axes, operating means for moving said doors between closed and open positions relative to said opening comprising:

a rotatable shaft extending transversely of said axes and fixedly mounted on the railway car, a linkage mechanism for each door rotatably mounted on said shaft, thread drive means on said shaft and on each of said mechanisms for moving the mechanisms lengthwise of the shaft attendant to rotation thereof, and connector link means operatively connected between the hanger means of the respective doors and each of said mechanisms, said link means being disposed in alignment with a generally horizontal radial plane of said shaft in the closed position of said doors whereby bending movements upon the shaft are reduced in said position.

2. The invention in accordance with claim 1, and each of said link means comprising a pair of links flanking said shaft pivotally connected to the associated linkage mechanism on an axis extending normal to the shaft and having connections to respective hanger means on an axis parallel to the axis of connection of said links to the associated linkage mechanism.

3. The invention in accordance with claim 2, and said axis of connection of each pair of links with the respective hanger means being located intermediate the upper and lower ends of the hanger means.

4. The invention in accordance with claim 2, and said shaft including cam means mounted thereon for rotation thereof, and cam actuating means positioned adjacent said hopper car and being engageable with said cam means for rotating said shaft as said railway car moves thereby.

5. The invention in accordance with claim 4, wherein said cam means include:

a first cam at one end of said shaft and a second cam at the other end of said shaft, said cam actuating means including a first cam actuator and a second cam actuator spaced therefrom, and gear means operatively disposed between said second cam and said shaft at one end of the shaft and including means producing reverse rotation of said shaft whereby said shaft is rotated in one direction when said first cam actuator engages said first cam and said shaft is rotated in the other direction when second cam actuator engages said second cam.

6. The invention in accordance with claim 1, and each of said link means comprising a pair of links flanking said shaft pivotally connected to the associated linkage mechanism on an axis extending normal to the shaft and having connections to respective hanger means on an axis parallel to the axis of connection of said links to the associated linkage mechanism, said axis of connection of each pair of links with the respective hanger means being located intermediate the upper and lower ends of the hanger means, said links angling upwardly and outwardly from the shaft attendant to movement of the doors from a closed to an open position and assuming an acute angle position relative to said shaft.

7. The invention in accordance to claim 6, and said shaft being horizontally disposed in a plane generally horizontally bisecting said hanger means.

* * * * *